US007093573B2

(12) United States Patent
Kunz et al.

(10) Patent No.: US 7,093,573 B2
(45) Date of Patent: Aug. 22, 2006

(54) METHOD FOR CONTROLLING AN INTERNAL COMBUSTION ENGINE

(75) Inventors: Franz Kunz, Altmannstein (DE); Hong Zhang, Tegernheim (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/522,475

(22) PCT Filed: Jan. 15, 2004

(86) PCT No.: PCT/EP2004/000266

§ 371 (c)(1),
(2), (4) Date: Jan. 26, 2005

(87) PCT Pub. No.: WO2004/074646

PCT Pub. Date: Sep. 2, 2004

(65) Prior Publication Data

US 2005/0229884 A1 Oct. 20, 2005

(30) Foreign Application Priority Data

Feb. 20, 2003 (DE) ..... 103 07 307

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | | |
|---|---|---|---|---|
| 5,218,935 | A * | 6/1993 | Quinn et al. | 123/90.17 |
| 5,522,352 | A | 6/1996 | Adachi et al. | |
| 6,196,173 | B1 | 3/2001 | Takahashi et al. | |

FOREIGN PATENT DOCUMENTS

| | | |
|---|---|---|
| DE | 199 46 077 A1 | 4/2001 |
| DE | 101 08 055 C1 | 8/2002 |
| EP | 0 852 287 A1 | 7/1998 |
| JP | 07 083080 | 3/1995 |

* cited by examiner

*Primary Examiner*—Thomas Denion
*Assistant Examiner*—Zelalem Eshete

(57) ABSTRACT

An internal combustion engine has a camshaft whose phase can be adjusted with respect to a crankshaft by means of a setting mechanism. Also provided are a crankshaft sensor which senses the crankshaft angle and a camshaft sensor which senses the camshaft angle. The method comprises the following steps: A reference value for the phase is adapted in a predefined position of the setting mechanism when a predefined condition is satisfied. A measurement value for the phase is determined depending on the sensed crankshaft angle and camshaft angle. A corrected measurement value for the phase is determined depending on the reference value and the measurement value for the phase. A control signal for controlling the internal combustion engine is determined depending on the corrected measurement value.

11 Claims, 5 Drawing Sheets

METHOD FOR CONTROLLING AN INTERNAL COMBUSTION ENGINE

CROSS REFERENCE TO RELATED APPLICATION

This application is the U.S. National Stage of International Application No. PCT/EP2004/000266, filed Jan. 15, 2004 and claims the benefit thereof. The International Application claims the benefits of German Patent application No. 10307307.8 DE filed Feb. 20, 2003, both of the applications are incorporated by reference herein in their entirety.

FIELD OF THE INVENTION

The invention relates to a method for controlling an internal combustion engine having a camshaft whose phase can be adjusted with respect to a crankshaft by means of a setting mechanism.

BACKGROUND OF THE INVENTION

A method for controlling an internal combustion engine having a camshaft whose phase can be adjusted with respect to a crankshaft by means of a setting mechanism is known from DE 101 08 055 C1. The setting mechanism disclosed in that publication is a hydraulic system by means of which the phase relationship between the crankshaft and the camshaft can be adjusted. Setting mechanisms of this type are widely used in modern internal combustion engines and are used on the one hand to improve performance and on the other hand to reduce emissions in the internal combustion engine.

With regard to the method known from DE 101 08 055 C1, near to the time when the internal combustion engine starts up a measurement value is determined for the phase between the crankshaft and the camshaft depending on sensed camshaft and crankshaft angles. A predefined initialization value is read in from a memory. The initialization value of the phase relationship is the value of the phase which the camshaft and the crankshaft have with respect to one another when all the mechanical components are arranged in the predefined manner with respect to one another. Such initialization values are typically fixed and predefined by the manufacturer of the internal combustion engine for all internal combustion engines of a series and stored in the control facilities provided for this purpose.

A correction value for the phase is then determined near to the time when the internal combustion engine starts up, depending on the difference between the initialization value and the measurement value for the phase. During the further operation of the internal combustion engine, the current phase in each case is then determined from the sum of the measurement value and the correction value. With regard to the known method, it is assumed that errors in the measurement value for the phase can essentially be attributed to the tolerances for the crankshaft sensor and the camshaft sensor. It has become apparent however that in spite of these corrections the desired low-emission operation of the internal combustion engine is not always guaranteed.

SUMMARY OF THE INVENTION

The object of the invention is to set down a method for controlling an internal combustion engine having a camshaft whose phase can be adjusted with respect to a crankshaft by means of a setting mechanism, which ensures low-emission operation.

This object is achieved by the features of the independent claim. Advantageous embodiments of the invention are set down in the subclaims.

The invention is based on the knowledge that during operation of the internal combustion engine when there is a rigid assignment between the initialization value and a reference value an error occurs during operation of the internal combustion engine when generating the setting signal. In this situation, it has surprisingly become apparent that errors can be attributed not only to tolerances and drift phenomena relating to the crankshaft sensor and the camshaft sensor but also to changes or wear in the area of the setting mechanisms or also in other elements which are used for coupling purposes between the crankshaft and the camshaft, such as corresponding gear wheel or a chain. Considerable changes can thus occur in the actual phase relationship between the crankshaft and the camshaft which for example in comparison with the initialization value for the phase relationship can come to up to +−15° crankshaft and thus significantly influence the mass flow feed into the cylinders of the internal combustion engine. On the basis of this knowledge, in accordance with the object of the independent claim a reference value for the phase is adapted in a predefined position of the setting mechanism when a predefined condition is satisfied. During further operation of the internal combustion engine a corrected measurement value for the phase is then determined depending on the reference value and a measurement value for the phase. It is therefore then simple to ensure that the internal combustion engine is capable of low-emission operation.

In an advantageous embodiment of the invention the predefined condition is satisfied when a motor vehicle in which the internal combustion engine can be located has traveled a predefined journey distance since the last adaptation and predefined ambient conditions exist. This embodiment of the condition is characterized by the fact that it ensures simple and precise adaptation with a reasonable computational effort.

A further advantageous embodiment of the invention is characterized by the fact that the ambient conditions exist when the temperature of the internal combustion engine lies within a predefined range. This has the advantage that no falsification is incorporated during the adaptation as a result of any temperature drift of the sensors which may possibly actually occur.

If the adaptation takes place near to the time when the internal combustion engine starts up, this has the advantage that the setting mechanism is situated in the end position predefined by the mechanical setup and a precise adaptation of the reference value is thus guaranteed.

If the adaptation takes place depending on a variable which is characteristic of the load on the internal combustion engine, then as a result a precise adaptation can simply take place since the load on the internal combustion engine is substantially responsible for changes in the reference position.

In this situation the method becomes particularly simple if the variable which is characteristic of the loading on the internal combustion engine is the journey distance or the method becomes particularly precise if this variable is a variable which is characteristic of the full load acceleration.

It is particularly advantageous if the variable which is characteristic of the loading on the internal combustion engine is a variable which is characteristic of an uneven running state. As a result the method becomes particularly precise and can go back to a variable which is calculated in any case for other control or diagnostic functions of the internal combustion engine in a control unit of the internal combustion engine.

The method also becomes particularly simple if the variable which is characteristic of the loading on the internal combustion engine is the period of operation of the internal combustion engine.

It is also particularly advantageous if the diagnostics for the internal combustion engine are carried out depending on the adapted reference value or a value which determines the adaptation, then precise diagnostics are also enabled at the same time using a value which is calculated in any case by the method.

BRIEF DESCRIPTION OF THE DRAWINGS

Exemplary embodiments of the invention will be described in the following with reference to the schematic drawings, in which.

Elements having the same design or function bear the same reference characters across all the figures.

DETAILED DESCRIPTION OF THE INVENTION

Figure 1:
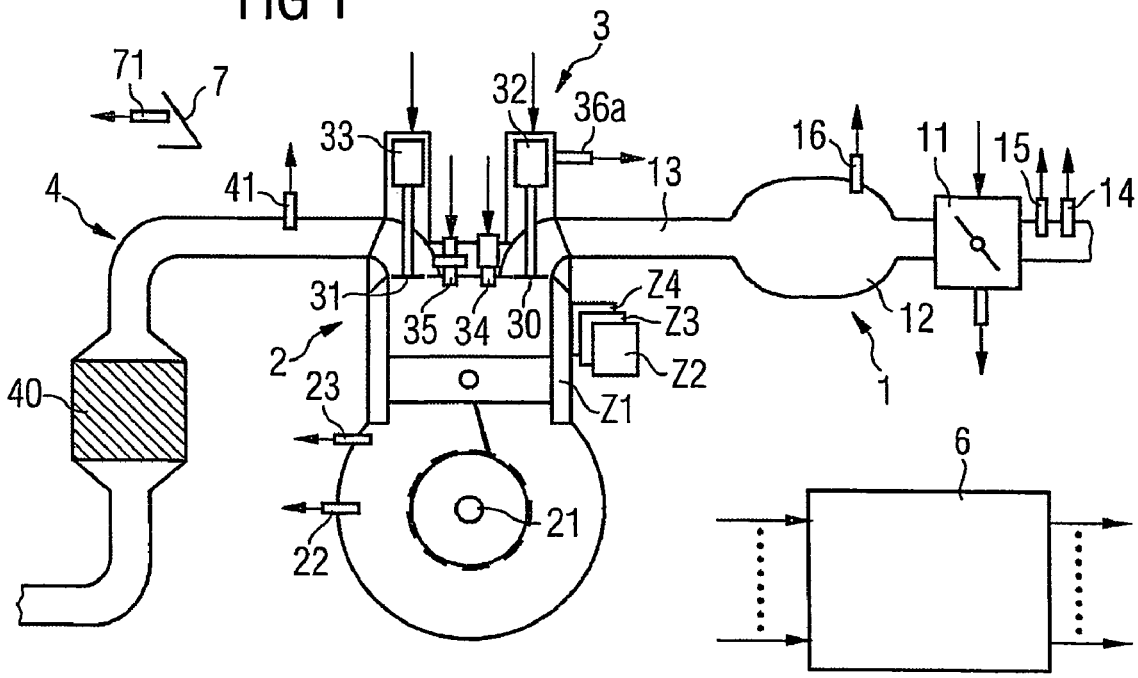
FIG. 1 shows an internal combustion engine having a control unit in which the method for controlling the internal combustion engine is processed.

An internal combustion engine (see FIG. 1) comprises an intake tract 1, an engine block 2, a cylinder head 3 and an exhaust tract 4. The intake tract preferably comprises a throttle valve 11, and also a header 12 and an induction manifold 13 which is routed towards a cylinder Z1 by way of an inlet port into the engine block. The engine block also comprises a crankshaft 21 which is coupled by way of a connecting rod to the piston of the cylinder Z1.

Figure 2:
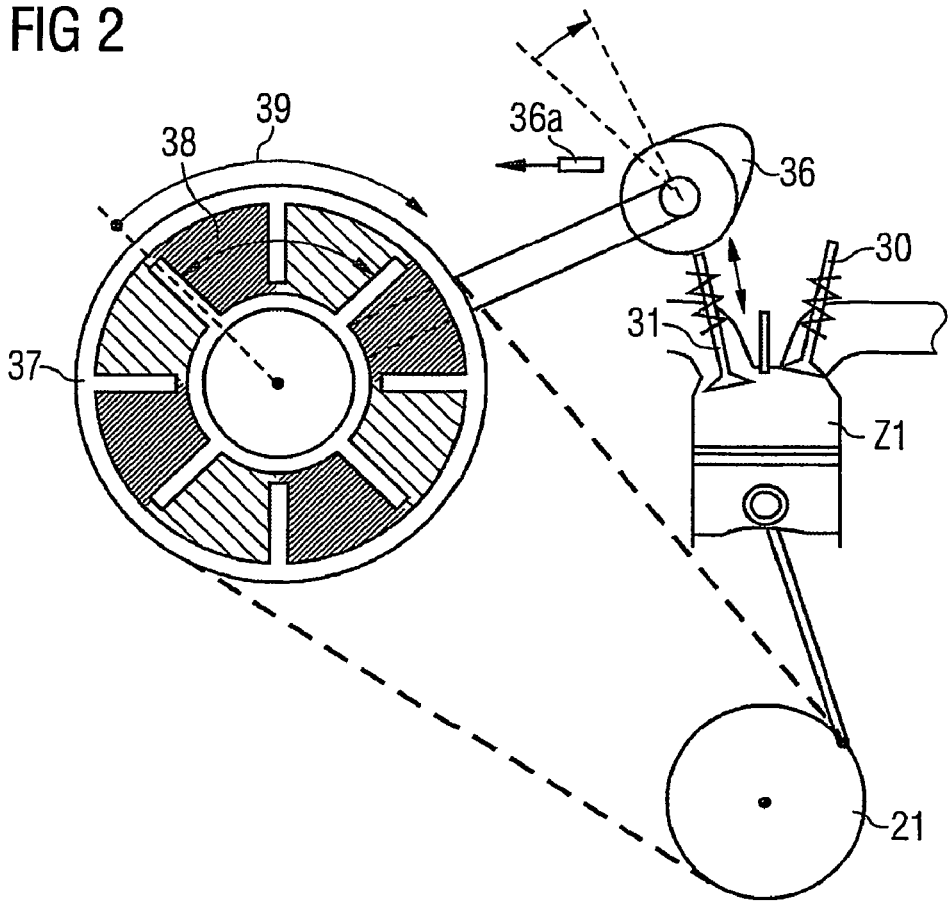
FIG. 2 shows a setting mechanism assigned to the internal combustion engine according to FIG. 1 for adjusting the phase between a camshaft and a crankshaft.

The cylinder head comprises a valve drive assembly comprising an inlet valve 30, an outlet valve 31 and valve drives 32, 33. In this situation, the drive for the gas inlet valve 30 and for the gas outlet valve 31 is preferably effected by means of a camshaft 36 (see FIG. 2), or should the occasion arise by means of two camshafts whereby one is assigned to the gas inlet valve 30 and one to the gas outlet valve 31. The drive for the gas inlet valve 30 and/or the gas outlet valve 31 preferably comprises, in addition to the camshaft 36, a setting mechanism 37 which is coupled on the one side with the camshaft 36 and on the other side with the crankshaft 21, for example by way of toothed wheels which are coupled to one another by way of a chain. The phase between the crankshaft 21 and the camshaft 36 can be adjusted by means of the setting mechanism. This is done in the present exemplary embodiment by increasing the pressure in the high-pressure chambers 38 of the setting mechanism 37 or by reducing the corresponding pressure, depending on the direction in which the adjustment is to be made. The possible range of adjustment is indicated in FIG. 2 by the arrow 39.

Figure 3:
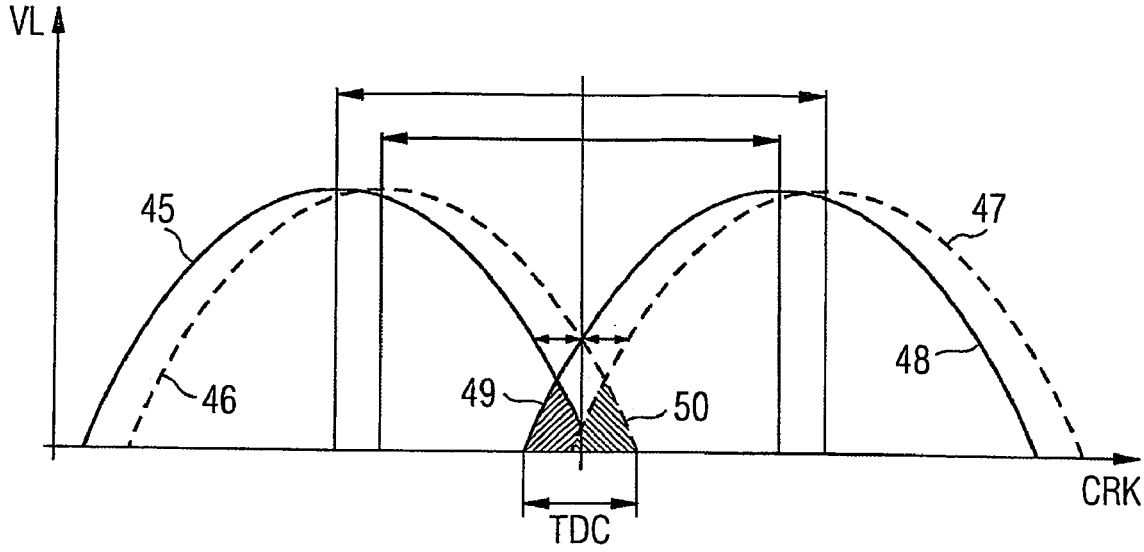
FIG. 3 shows valve stroke progression curves for the gas-reversing valves, plotted against the crankshaft angle.

The valve lift curves 46, 47 represented as dashed lines (FIG. 3) for the inlet valves 30 and outlet valves 31 illustrate the situation in which they match the initialization value. During operation of the internal combustion engine these valve lift curves can however change towards the valve lift curves 45 and 48. This has the consequence that with the valve drive in its end position the valve overlap between the gas inlet and gas outlet valves can then be different to the original valve overlap and their phases or their position can also be displaced with reference to the crankshaft angle.

Trials have shown that a displacement of up to +/−15° crankshaft can result in this situation. Such displacements then result in changed gas-reversing operations and changed combustion operations, as a result of which without the method described in the following it is then no longer possible to ensure that the desired torque is set on the one hand and that low-emission operation of the internal combustion engine is guaranteed on the other hand.

The cylinder head 3 (FIG. 1) additionally comprises an injection valve 34 and a spark plug 35. Alternatively, the injection valve can also be located in the intake tract.

A catalytic converter 40 is located in the exhaust tract. In addition, a control unit 6 is provided which has sensors assigned to it that sense different measured variables and determine the measurement value of the measured variable in each case. Depending on at least one of the measured variables, the control unit 6 determines regulating variables which are then converted into one or more control signals for controlling the control elements by means of appropriate actuators.

The sensors are a pedal position sensor 71 which senses the position of an accelerator pedal, an air mass meter 14 which senses an air mass flow upstream of the throttle valve 11, a temperature sensor 15 which senses the intake air temperature, a pressure sensor 16 which senses the induction manifold pressure, a crankshaft angle sensor 22 which senses a crankshaft angle CAM, a further temperature sensor 23 which senses a coolant temperature, a camshaft sensor 36 which senses the camshaft angle CRK and an oxygen probe 41 which senses the residual oxygen content of the exhaust in the exhaust tract 4 and assigns an air ratio to the latter. Depending on the embodiment of the invention, any desired subset of the aforementioned sensors, or also additional sensors, can be present.

The control elements are for example the throttle valve 11, the gas inlet and gas outlet valves 30, 31, the injection valve 34, and the spark plug 35. They are driven by means of electrical, electromechanical, hydraulic, mechanical piezo or further actuators known to the person skilled in the art. The actuators and control elements are referred to in the following as control elements.

In addition to the cylinder Z1 represented in detail, further cylinders Z2 through Z4 are usually present in the internal combustion engine, with which cylinders are then associated corresponding induction manifolds, exhaust tracts and control elements.

Figure 4:
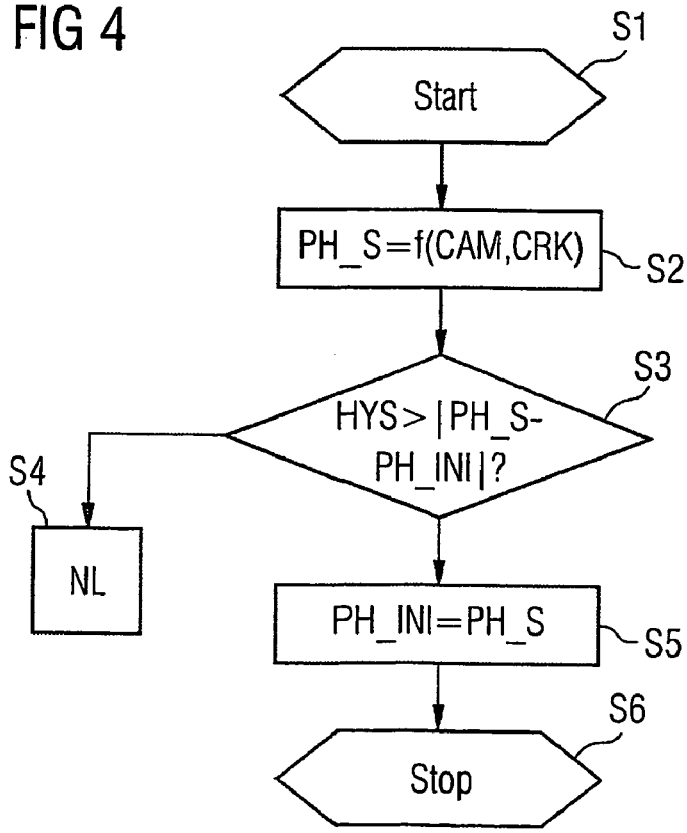
FIG. 4 shows a flowchart of a program for one part of the method for controlling the internal combustion engine.

FIG. 4 shows a flowchart of a program for a first part of the method for controlling the internal combustion engine. The program is started in a step S1 and this preferably occurs when the internal combustion engine has been completely assembled and subjected to a final test, the so-called end-of-line test. It is however also advantageous to start the method in each situation when mechanical intervention has occurred in respect of the crankshaft 21, the camshaft 36, the setting mechanism 37 or any other parts serving to provide the coupling between the crankshaft 21 and the camshaft 36. Such a situation exists for example when the chain which serves to couple the crankshaft to the camshaft is replaced or has been re-tensioned.

In a step S2 a measurement value is calculated for the phase depending on the measurement values determined by the camshaft sensor 36*a* and the crankshaft angle sensor 22 for the camshaft angle CAM and the crankshaft angle CRK. In this situation, the phase between the camshaft and the crankshaft is related to degrees crankshaft, the top dead center TDC for the piston assigned to the cylinder Z1 in each case and the vertex of the valve lift VL of the inlet valve 30 or the outlet valve 31 respectively. Sensing of the measurement value PH_S for the phase takes place in step S2 under predefined ambient conditions, preferably at a predefined temperature for the internal combustion engine.

In a step S3 a check is performed as to whether the measurement value PH_S deviates by more than a first threshold value HYS from the initialization value PH_INI for the phase. The initialization value PH_INI is a predefined value for the phase for a plurality of internal combustion engines employing the same construction, in other words a series of internal combustion engines for example. The initialization value PH_INI for the phase is ideally adopted by all internal combustion engines when the setting mechanism is located at its end stop which is given by the base of the arrow 39 in FIG. 2.

If in step S3 the deviation exceeds the threshold value HYS, then an emergency mode of operation for the internal combustion engine in which only restricted operation of the internal combustion engine is enabled is controlled in a step S4. If the program is started in step S1 during an end-of-line test, then in step S8 suitable means also enable a signal to be made indicating that the internal combustion engine has not been properly assembled or is not in working order.

If the condition in step S3 is not satisfied, however, then in a step S5 the measurement value PH_S is assigned to the initialization value PH_INI. As a result, the phase present with regard to the respective individual internal combustion engine at the end stop of the setting mechanism 37 is then precisely stored. In a step S6 the program is then terminated.

Figure 5:
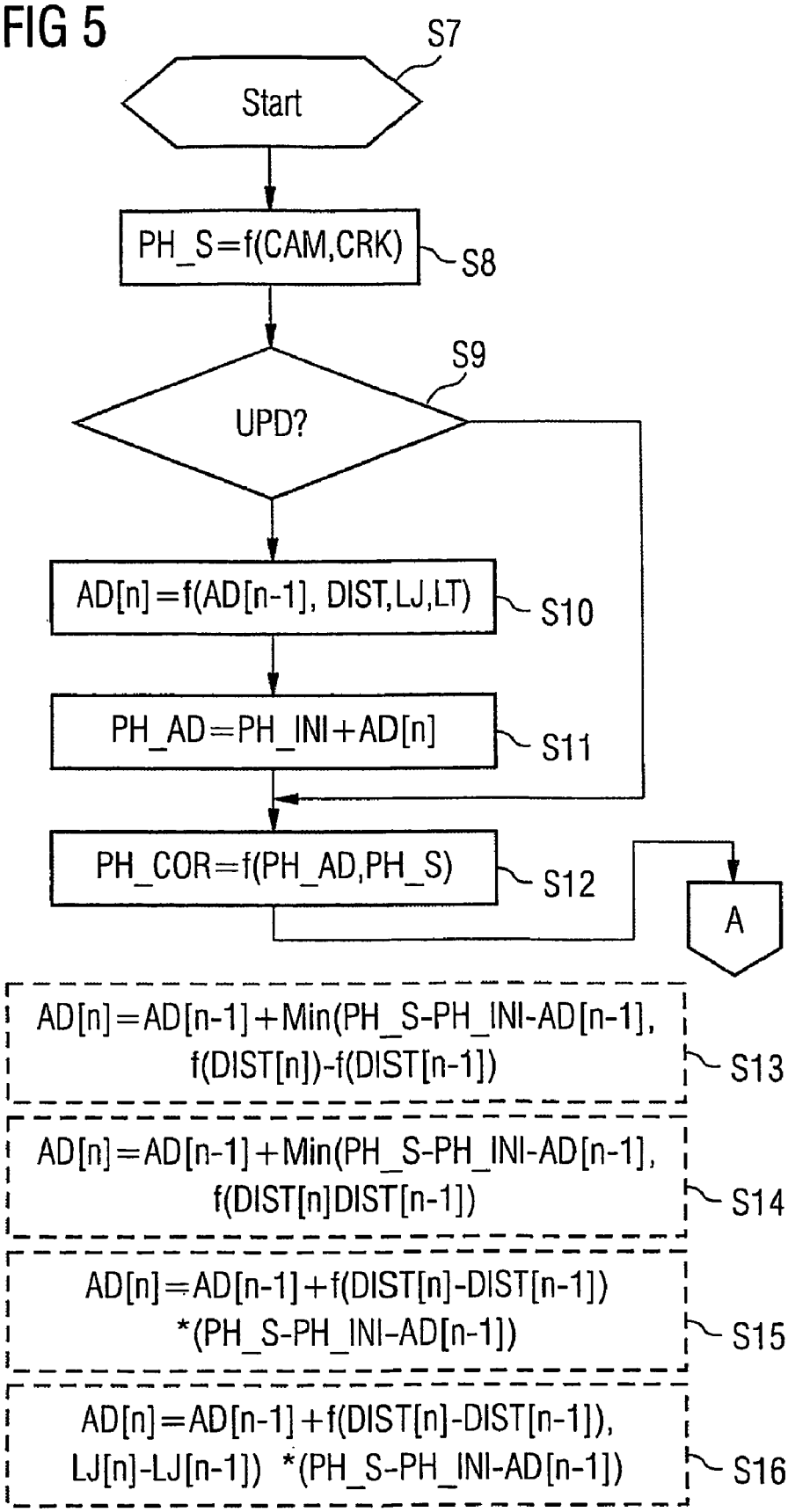
FIGS. 5, 6 show a flowchart of a program for a further part of the method for controlling the internal combustion engine.

A program for a further part of the method for controlling the internal combustion engine is started in a step S7 (see FIG. 5).

In a step S8, a measurement value PH_S for the phase is determined depending on the sensed crankshaft angles CRK and camshaft angles CAM. In a step S9, a check is performed as to whether an update condition UPD is satisfied. In this situation, a check is preferably performed as to whether the internal combustion engine was started at a point close in time, in other words whether it is still running within the initial rotations of the crankshaft. A check is also performed as to whether a minimum number of driven kilometers has been reached since the last adaptation of a reference value PH_AD. Finally, a further check is performed as to whether given ambient conditions, such as preferably a predefined temperature for the internal combustion engine, are met. In this situation, the temperature of the internal combustion engine is preferably determined depending on the sensed coolant temperature.

If the conditions for step S9 are satisfied, then an adaptation value AD is determined in a step S10. The n enclosed in square brackets signifies in each case that the assigned value for the current calculation cycle is valid as a new value whereas n−1 signifies that the corresponding value in the last calculation cycle was the current value.

The adaptation value is determined in step S10 depending on the adaptation value from the last calculation cycle, and/or a journey distance DIST and/or a number of full-load accelerations LJ and/or a period of operation LT. It can also be determined additionally or exclusively depending on a variable which is characteristic of an uneven running state of the internal combustion engine or another variable which is characteristic of the loading of the internal combustion engine through its period of operation. In a step S11, a reference value PH_AD for the phase of the crankshaft and the camshaft in the end position of the setting mechanism 37 is then determined from the sum of the initialization value and the current adaptation value AD.

In a step S12, a correction value PH_COR is then determined depending on the reference value PH_AD and the measurement value PH_S for the phase. Simple and additional compensation is then carried out through this correction value PH_COR for temperature and other sensor errors. Step S12 is also processed if the conditions for step S9 are not satisfied.

Concrete embodiments of the determination of the adaptation value AD in step S10 are represented in steps S13 through S16. Thus, the adaptation value is determined for example by means of the formula specified in step S13, whereby Min represents a minimum choice from the two terms separated by commas. The second term of the minimum choice is the difference between two values which are determined depending on the journey distance at the current calculation time point and at the preceding calculation time point and thus represent a maximum change in the adaptation value AD between two successive adaptations. In this situation, these values are preferably determined by means of appropriate driving trials and/or appropriate modeling and are preferably placed in a characteristic field. This procedure serves to ensure in a simple manner that the change in the adaptation value AD in step S13 is limited in terms of scale to a maximum change which is predefined by a modeling process.

The procedure according to step S14 with regard to determining the adaptation value AD differs from that of step S13 in that the second term of the minimum choice is a value which is determined depending on the difference between the current journey distance DIST and the journey distance DIST present in the last cycle of step S14. The value also represents a model value, whereby in contrast to step S13 it is not the absolute journey distances which are decisive here but only the relative journey distances are taken into consideration. In this case too the calculation of the value is preferably carried out using a characteristic field.

In steps S15 and S16, the calculation of the adaptation value takes place by means of a PT1 filtering process. To this end, to the adaptation value determined in the last cycle of step S15 is added a term which contains a weighting value that is dependent on the difference between the journey distance DIST at the current calculation time point and the journey distance during the last calculation cycle of step S15. This weighting value is multiplied by the difference between the deviation of the current measurement value PH_S and initialization value PH_INI and the adaptation value during the preceding calculation cycle of step S15. In this situation, the weighting factor is preferably determined from a characteristic field, stored in the control unit 6, which has been determined through driving trials or on the engine test bed.

Step S16 is distinguished from step S15 by the fact that the weighting factor is additionally or alternatively determined depending on a variable which is characteristic of the full-load accelerations, in other words the number of these for example. The procedures described in steps S13 through S16 for determining the adaptation value have the advantage in each case that the respective variables which are relevant there have an influence on the change in the reference position and thus contribute to an exact and precise adaptation.

Figure 6:
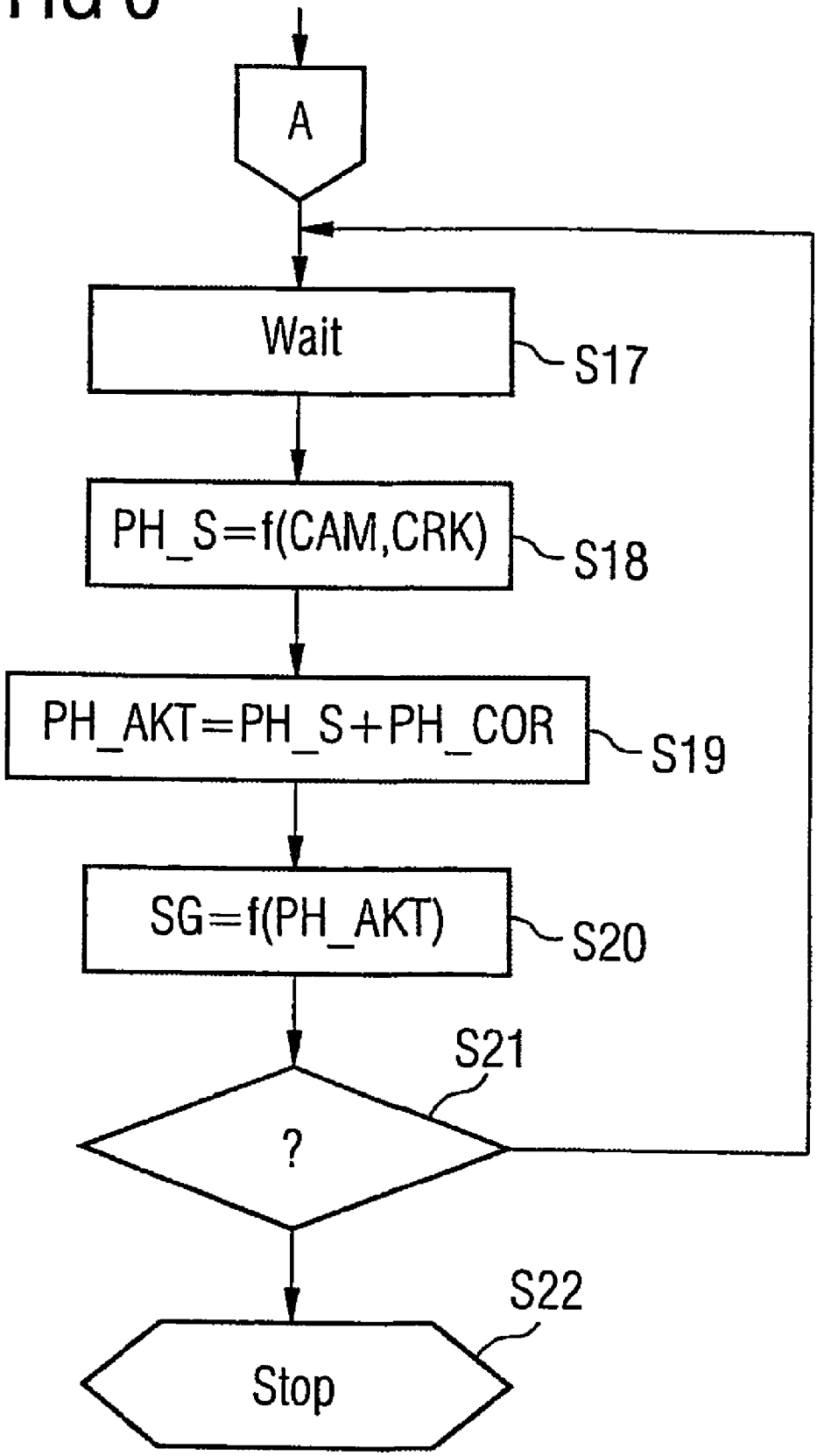

In a step S17 (see FIG. 6), which follows step S12, the program enters a wait state until a predefined period of time has lapsed or until the crankshaft has advanced by a predefined angle. In this state, the program is preferably interrupted and the computing power of the control unit 6 is made available to other programs.

In a step S18, a measurement value PH_S for the phase is then determined depending on the camshaft angle CAM and the crankshaft angle CRK. In a step S19, a corrected measurement value PH_AKT is then determined from the sum of the measurement value PH_S and of the correction value PH_COR.

In a step S20, a control signal SG for controlling the internal combustion engine is then determined, depending on the corrected measurement value PH_AKT. This is done for example by means of a so-called induction manifold model which uses appropriate observer equations to determine an estimated value for the air mass metered into the cylinder Z1, depending on the corrected measurement value PH_AKT for the phase between the crankshaft 21 and the camshaft 36 and on further measured variables such as the sensed air mass flow, the throttle valve degree of opening, the temperature of the intake air and where necessary the sensed induction manifold pressure. Depending on the estimated value for the air mass metered into the cylinder Z1, a desired fuel mass is then determined and the injection valve 34 is then controlled by means of an appropriate control signal. In a step S21, a check is then performed as to whether a termination condition for the program is satisfied. This can for example consist in the fact that the internal combustion engine is stopped. If the condition for step S19 is satisfied, then the program is terminated in step S22. Otherwise, the program is continued in step S17.

Figure 7:
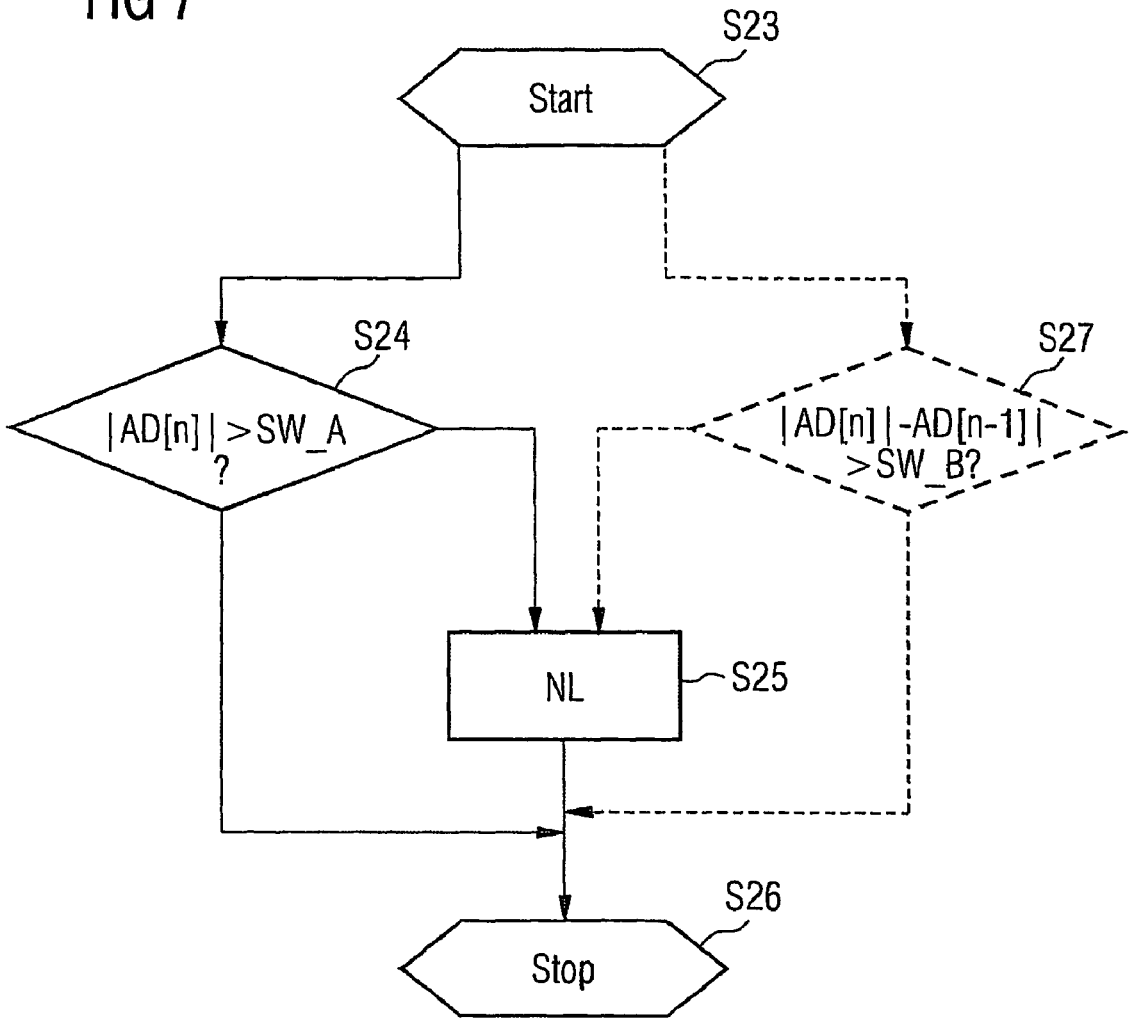
FIG. 7 shows a program for a method for performing diagnostics on the internal combustion engine.

Diagnostics are performed on the internal combustion engine by means of the program represented in FIG. 7. The program is started in a step S23. In a step S24, a check is performed as to whether the current adaptation value is greater than a further threshold value SWA. The further threshold value SWA is fixed and predefined, and preferably determined by trials on an engine test bed or in driving trials. If the condition for step S24 is satisfied, then the internal combustion engine is placed in an emergency mode of operation in a step S25. If the condition for step S24 is not satisfied however, then the program is terminated in step S26. As an alternative to step S24, a step S27 can also be provided in which a check is performed as to whether the change in the adaptation values from one calculation time point for the adaptation value to the next calculation time point exceeds a predefined further threshold value SWB. If this is the case, then the internal combustion engine is placed in the emergency mode of operation in step S25. Otherwise, the program is terminated in step S26.

The invention claimed is:

1. A method for controlling an internal combustion engine having a camshaft, a crankshaft sensor, and a camshaft sensor, comprising:

adapting a reference value for a phase of the camshaft in a predefined position of a setting mechanism when a predefined condition is satisfied:

determining a measurement value for the phase depending on a sensed crankshaft angle and a camshaft angle;

determining a corrected measurement value for the phase depending on the reference value and the measurement value for the phase; and determining a control signal for controlling the internal combustion engine depending on the corrected measurement value, wherein the predefined condition is satisfied when a motor vehicle containing the internal combustion engine has traveled a predefined journey distance since the last adaptation and a set of predefined ambient conditions are present.

2. The method according to claim 1, wherein the set of ambient conditions are present when the temperature of the internal combustion engine lies within a predefined range.

3. The method according to claim 1 wherein the adaptation takes place near a time when the internal combustion engine starts up.

4. The Method according to claim 1, wherein the adaptation takes place depending on a variable that is characteristic of a load on the internal combustion engine.

5. A method for controlling an internal combustion engine having a camshaft, a crankshaft sensor, and a camshaft sensor, comprising:

adapting a reference value for a phase of the camshaft in a predefined position of a setting mechanism when a predefined condition is satisfied;

determining a measurement value for the phase depending on a sensed crankshaft angle and a camshaft angle;

determining a corrected measurement value for the phase depending on the reference value and the measurement value for the phase; and determining a control signal for controlling the internal combustion engine depending on the corrected measurement value, wherein the adaptation takes place depending on a variable that is characteristic of a load on the internal combustion engine, wherein the variable that is characteristic of the load on the internal combustion engine is the journey distance.

6. The method according to claim 4, wherein the variable that is characteristic of the load on the internal combustion engine is a variable that is characteristic of the full-load accelerations.

7. A method for controlling an internal combustion engine having a camshaft, a crankshaft sensor, and a camshaft sensor, comprising:

adapting a reference value for a phase of the camshaft in a predefined position of a setting mechanism when a predefined condition is satisfied;

determining a measurement value for the phase depending on a sensed crankshaft angle and a camshaft angle;

determining a corrected measurement value for the phase depending on the reference value and the measurement value for the phase; and determining a control signal for controlling the internal combustion engine depending on the corrected measurement value, wherein the adaptation takes place depending on a variable that is characteristic of a load on the internal combustion engine, wherein the variable that is characteristic of loads on the internal combustion engine is a variable that is characteristic of the uneven running state.

8. The method according to claim 4, wherein the variable that is characteristic of the load on the internal combustion engine is the period of operation of the internal combustion engine.

9. A method for controlling an internal combustion engine having a camshaft, a crankshaft sensor, and a camshaft sensor, comprising:

adapting a reference value for a phase of the camshaft in a predefined position of a setting mechanism when a predefined condition is satisfied;

determining a measurement value for the phase depending on a sensed crankshaft angle and a camshaft angle;

determining a corrected measurement value for the phase depending on the reference value and the measurement value for the phase; and determining a control signal for controlling the internal combustion engine depending on the corrected measurement value, wherein diagnostics are performed on the internal combustion engine depending on the adapted reference value or a value defining the adaptation.

10. The method according to claim 5, wherein the variable that is characteristic of the load on the internal combustion engine is a variable that is characteristic of the full-load accelerations.

11. The method according to claim 7, wherein the variable that is characteristic of the load on the internal combustion engine is the period of operation of the internal combustion engine.

* * * * *